US005303940A

United States Patent [19]

Brandner

[11] Patent Number: 5,303,940

[45] Date of Patent: Apr. 19, 1994

[54] SKATE HAVING ANGULARLY MOUNTED WHEELS

[75] Inventor: Ernest E. Brandner, Orlando, Fla.

[73] Assignee: Jeannette L. Brandner, Orlando, Fla.

[21] Appl. No.: 941,947

[22] Filed: Sep. 8, 1992

Related U.S. Application Data

[63] Continuation of Ser. No. 685,545, Apr. 15, 1991, abandoned.

[51] Int. Cl.[5] ..... A63C 17/06

[52] U.S. Cl. ..... 280/11.22; 280/11.27; 301/1

[58] Field of Search ..... 280/7.13, 11.19, 11.2, 280/11.22, 11.23, 11.25, 11.27, 11.3, 87.041, 841, 842; 301/1, 5.3; 36/115

[56] References Cited

U.S. PATENT DOCUMENTS

| | | | |
|---|---|---|---|
| 7,345 | 5/1850 | Hyde . | |
| 327,517 | 10/1885 | Britt, Jr. | 280/11.22 X |
| 1,116,840 | 11/1914 | Porter | 280/11.22 |
| 1,552,541 | 9/1925 | Clark | 280/11.2 |
| 1,801,205 | 4/1931 | Mirick | 280/11.22 X |
| 1,975,661 | 10/1934 | Powell | 280/11.23 |
| 2,212,589 | 8/1940 | Decker | 280/11.25 |
| 2,412,290 | 12/1946 | Rieske . | |
| 3,287,023 | 11/1966 | Ware . | |
| 3,756,614 | 9/1973 | Grubin | 280/11.22 |
| 3,880,441 | 4/1975 | Silver . | |
| 3,885,804 | 5/1975 | Cudmore | 280/11.2 |
| 3,900,203 | 8/1975 | Kukulowicz . | |
| 3,963,252 | 6/1976 | Carlson . | |
| 4,272,090 | 6/1981 | Wheat | 280/11.22 |
| 4,323,259 | 4/1982 | Boudreau | 280/7.13 |
| 4,492,385 | 1/1985 | Olson . | |
| 4,618,158 | 10/1986 | Liberkowski . | |
| 4,909,523 | 3/1990 | Olson | 280/11.2 |
| 4,928,982 | 5/1990 | Logan | 280/11.22 |
| 4,995,626 | 2/1991 | Montague | 280/278 X |

FOREIGN PATENT DOCUMENTS

| | | | |
|---|---|---|---|
| 215734 | 11/1909 | Fed. Rep. of Germany | 280/11.23 |
| 1122229 | 9/1956 | France | 280/11.22 |
| 579406 | 10/1973 | Switzerland | 280/11.19 |
| 24729 | of 1915 | United Kingdom | 280/11.23 |

*Primary Examiner*—Brian Johnson
*Attorney, Agent, or Firm*—Julian C. Renfro

[57] ABSTRACT

A roller skate in accordance with this invention utilizes at least two angularly mounted wheels disposed generally in an in-line relationship. This skate comprises a mounting plate having a pair of oppositely disposed surfaces, with one of such surfaces being adapted to be fastened to the sole of a boot or shoe. At least one wheel mounting bracket is affixed along the longitudinal axis of the other surface of the mounting plate, for supporting the axles upon which the wheels of the skate are rotatably mounted, with the treads of the wheels disposed in alignment. The angular disposition of the wheels enables the user of my skate to achieve improved roll, and better traction during a turn and in a power stroke.

16 Claims, 8 Drawing Sheets

FIG 1
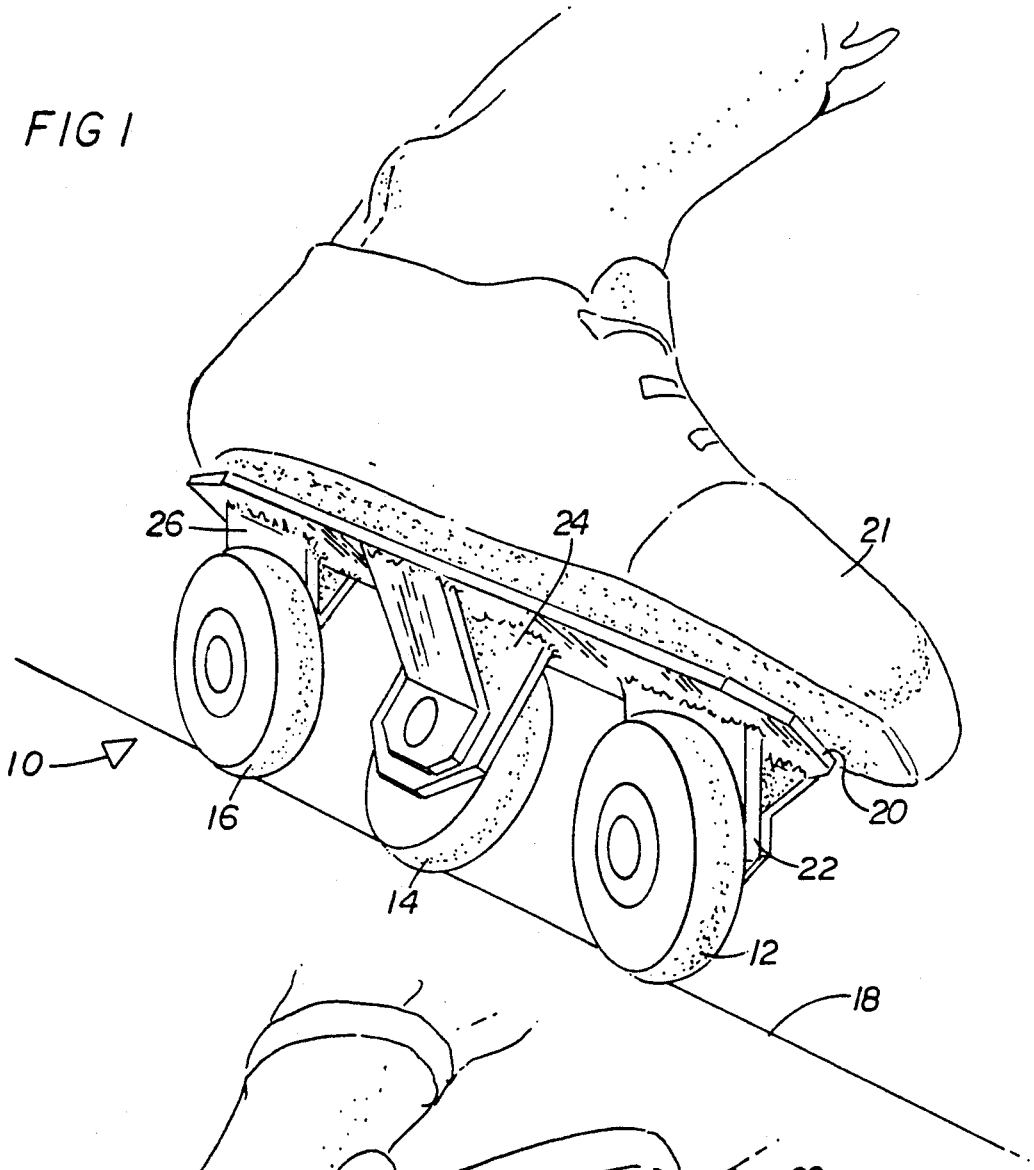
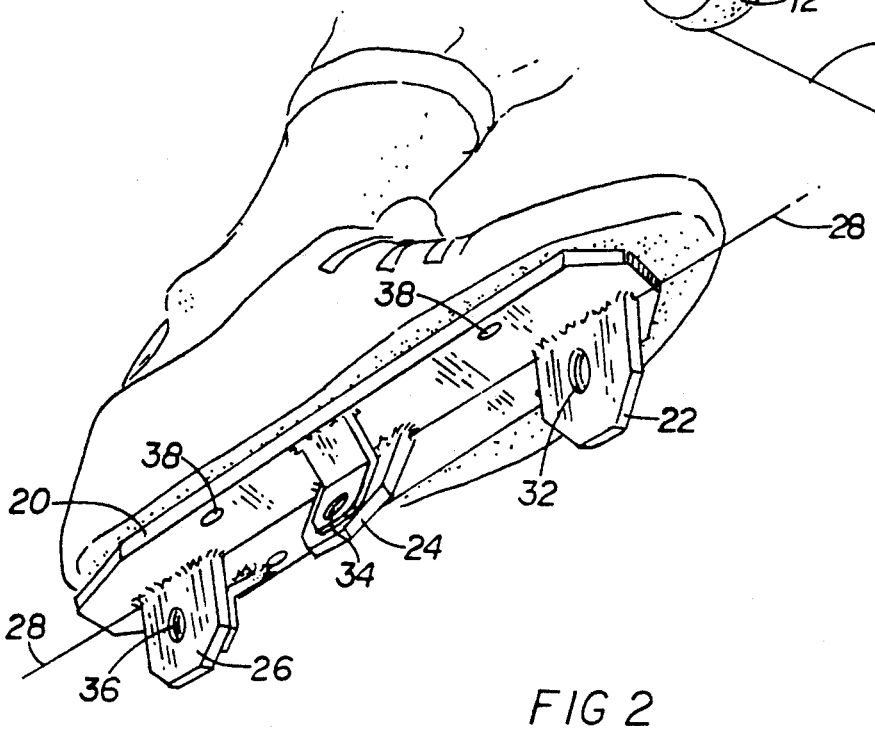
FIG 2

FIG 3
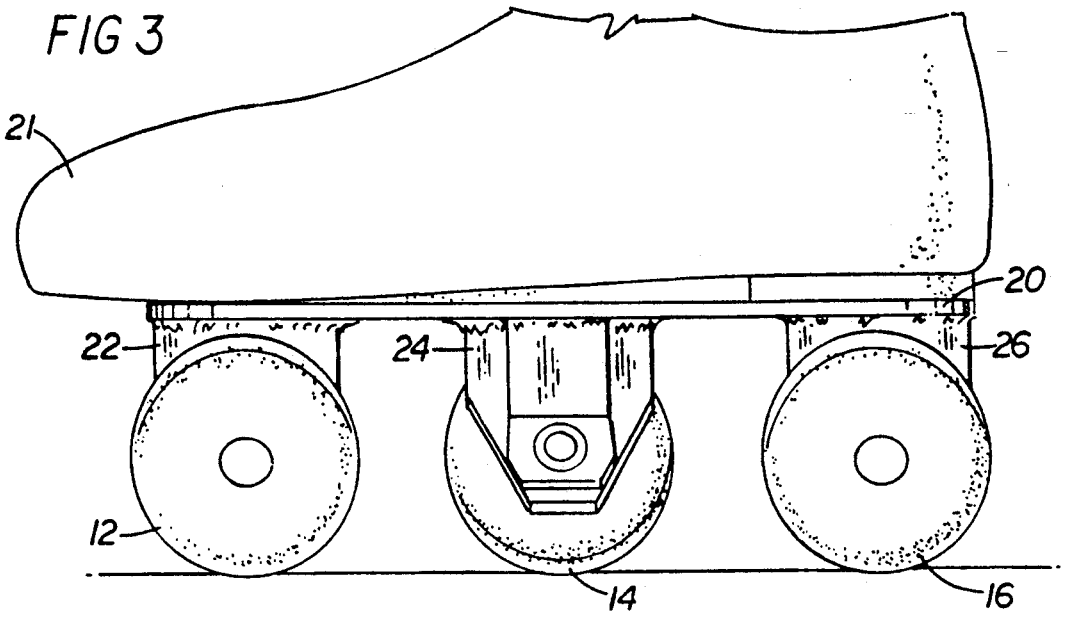
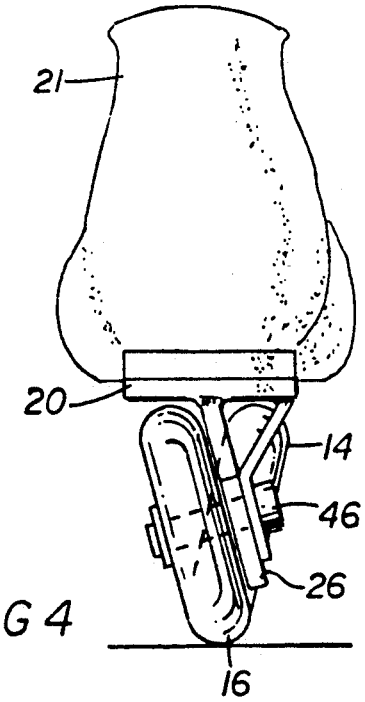
FIG 4
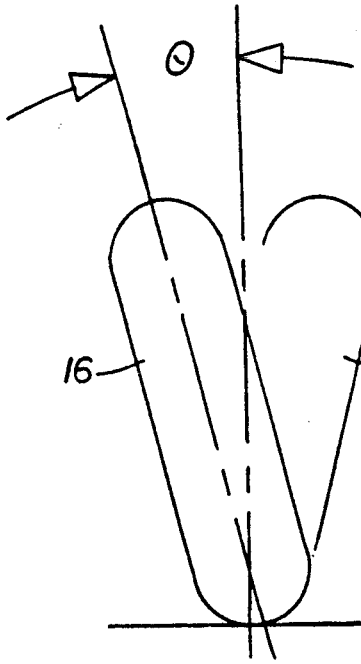
FIG 5

FIG 6a
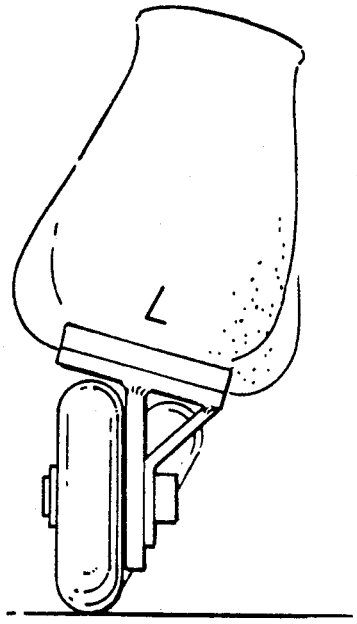
FIG6b
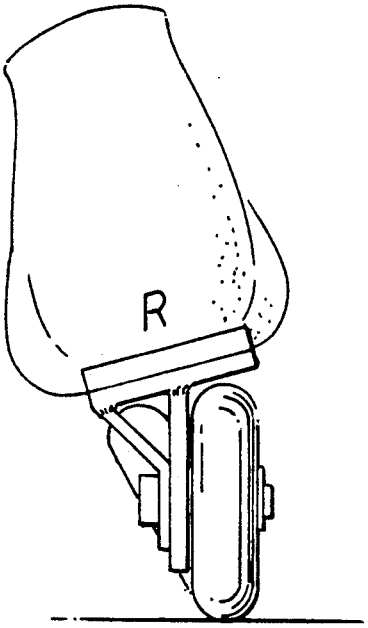
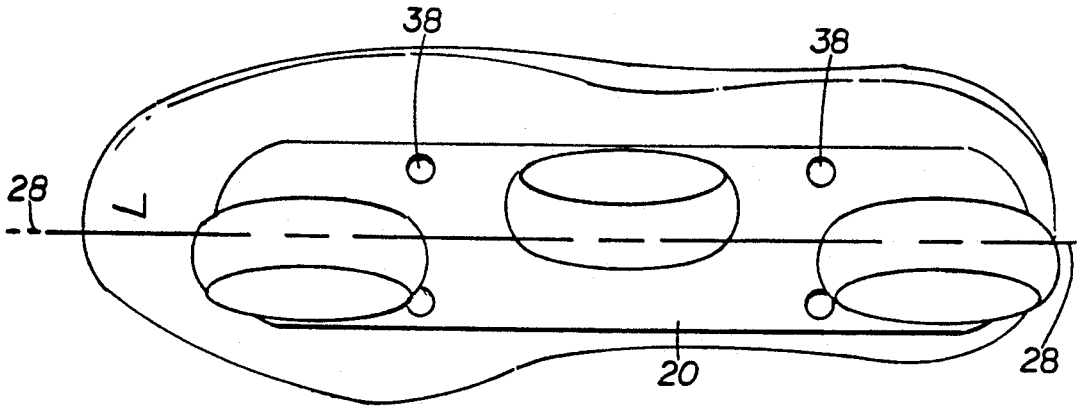
FIG 7
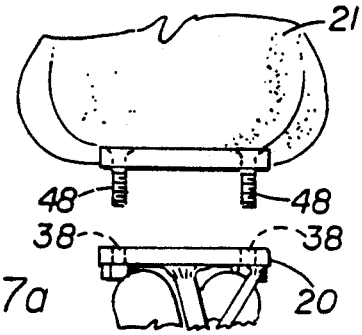
FIG 7a

FIG 8a
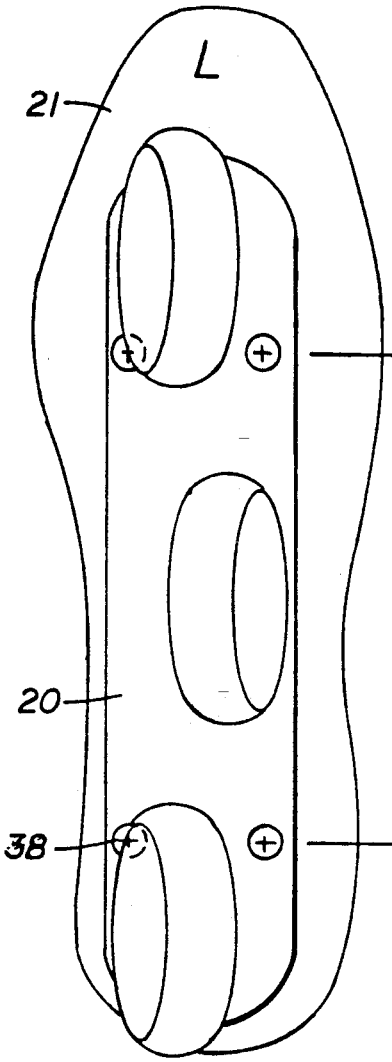
FIG 8b
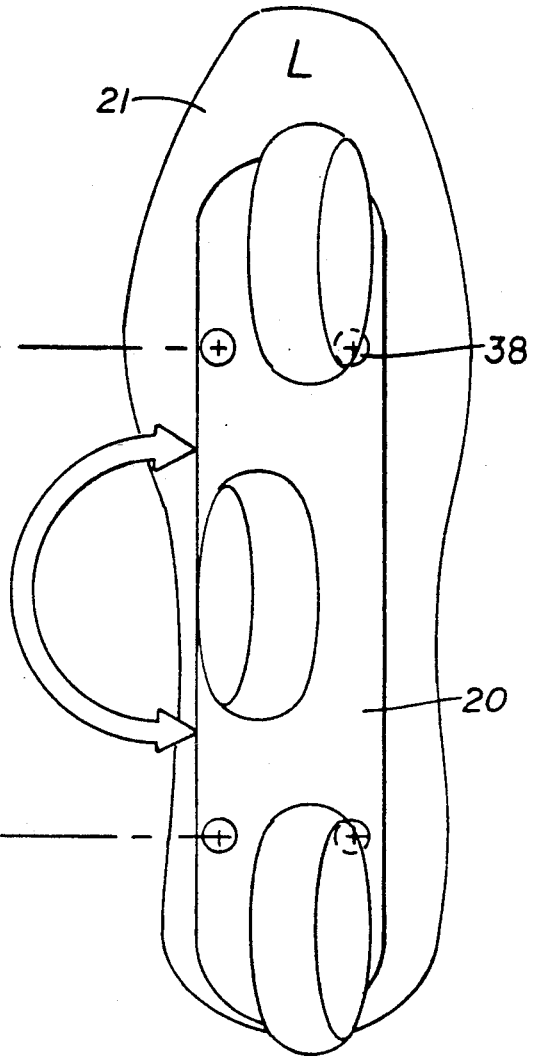
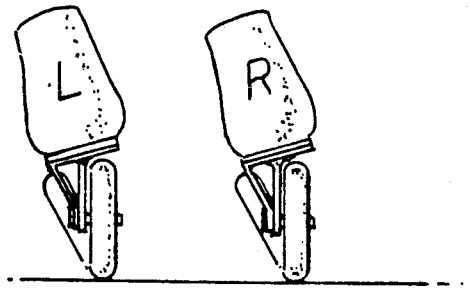
FIG 9

FIG 10
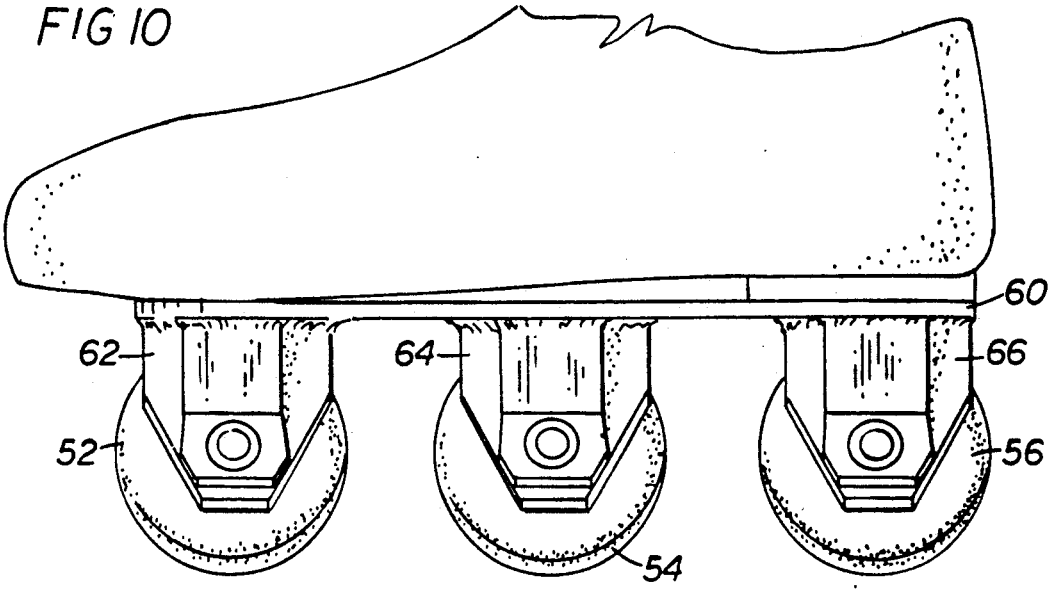
FIG 11a
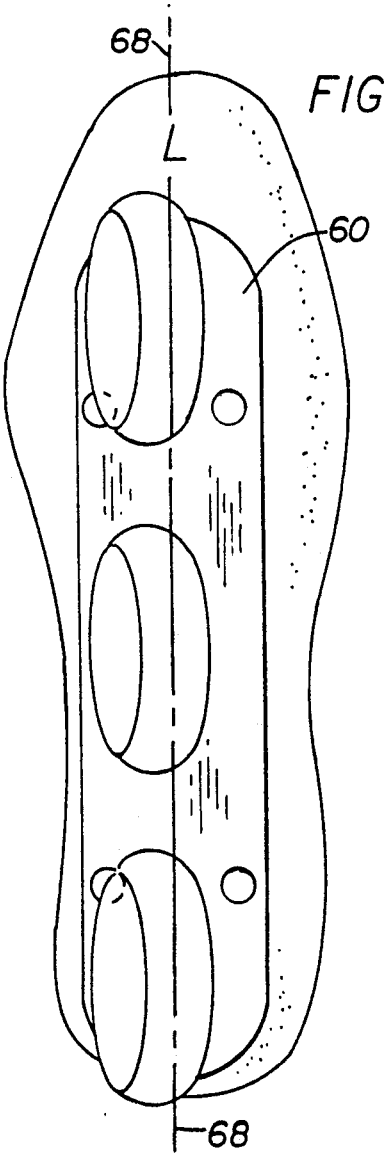
FIG 11b
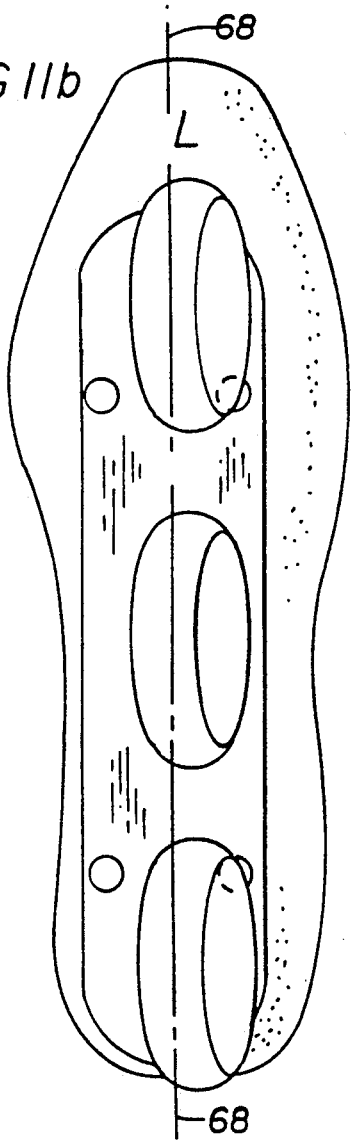
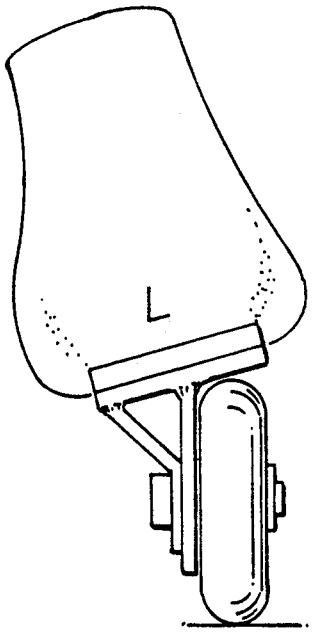
FIG 12

FIG 13
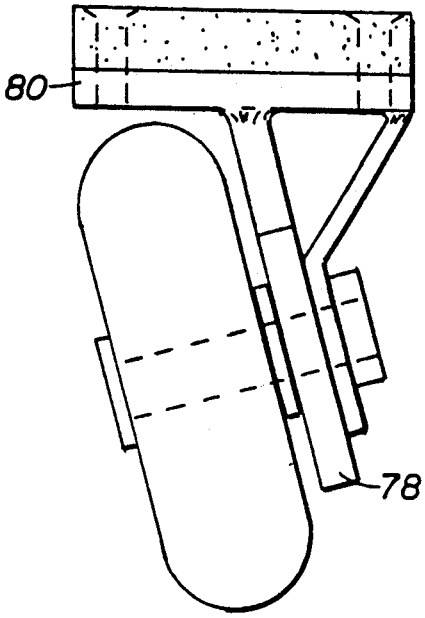
FIG 14
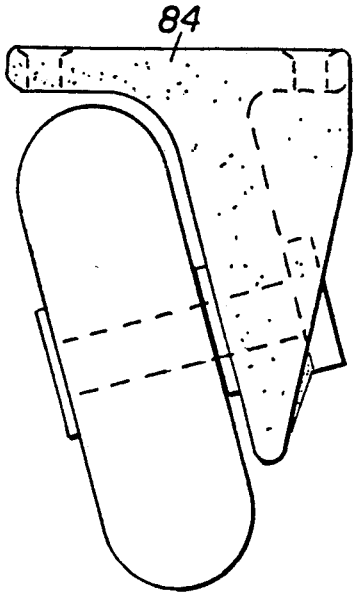
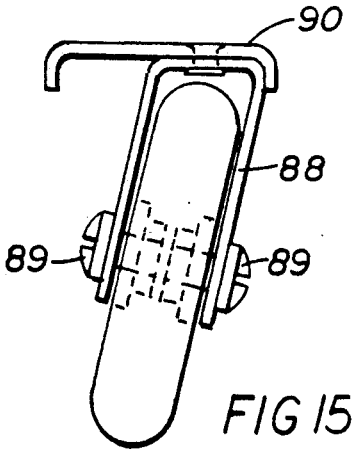
FIG 15
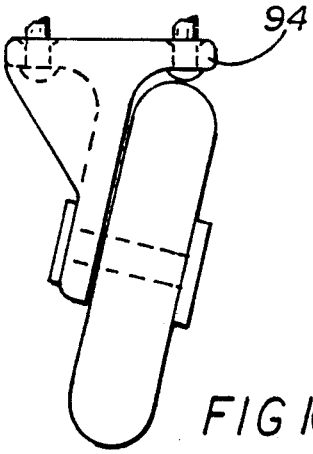
FIG 16
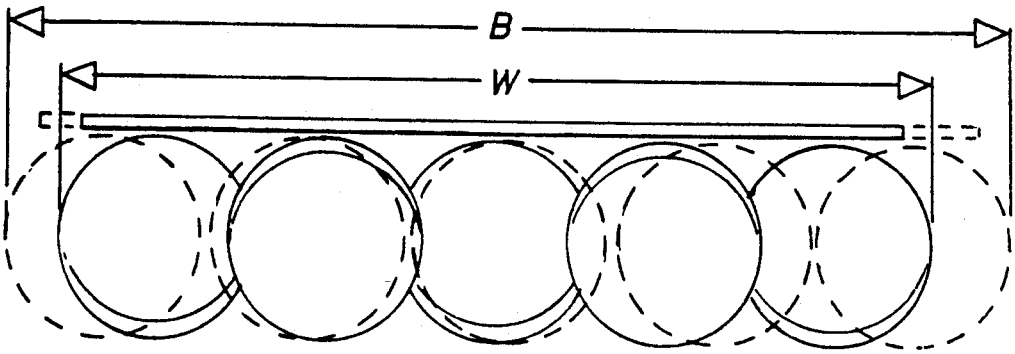
FIG 17

SKATE HAVING ANGULARLY MOUNTED WHEELS

This is a continuation of application Ser. No. 07/685,545 filed Apr. 15, 1991 now abandoned.

BACKGROUND OF THE INVENTION

1. Field of the Invention

This invention relates to in-line or tandem roller skates, and more particularly to a skate utilizing angularly mounted wheels whose ground contacting surfaces are in an in-line relationship, with the angular mounting of the wheels enabling the user to achieve improved traction during a turn.

2. Description of the Related Art

Many generations of children and adults alike have enjoyed the pleasures of roller skating, and originally, the roller skates they used were of the so-called "quad" type, with each skate having a pair of wheels in the front, and a pair of wheels in the back.

For reasons of increased speed and maneuverability, many skaters have stopped using quad skates, and have gone over to what are called linear skates, involving a design wherein the wheels of each skate are disposed along a straight line. Linear or in-line skates have at least three wheels, but may utilize four, five or possibly more wheels, for as a generality, the larger the number of wheels, the smoother the ride.

Conventional in-line or linear roller skates normally utilize two or more wheels positioned to rotate within a common vertical plane, and while operating as roller skates, have much of the feel and behavior associated with ice skates. Substantially the same bodily movements are required to operate both ice skates and in-line roller skates, and such roller skates have become increasingly popular with ice skaters as a desirable training tool for off season and on-street use. In recent years, in-line roller skates have been capturing an increasing share of the recreational skate market and in time may parallel jogging as a healthy and pleasurable adult sport.

Tandem or in-line skates are well known and appear at least as early as 1876 in U.S. Pat. No. 7,345 of C. W. Saladee, which disclosed a two-wheel in-line model featuring a somewhat complex, spring loaded carriage supporting laterally pivoting rollers for improved maneuverability and even distribution of skater weight. Unfortunately, this early device was heavy, noisy and quite complicated to manufacture and assemble.

In 1946, U.S. Pat. No. 2,412,290 to O. G. Rieske disclosed a heavy metal framed, three-wheel, in-line skate for indoor use which featured an endless, rubberized belt so as to avoid damage to wooden floors. The belt rotated on three pulley-like wheels wherein the intermediate wheel was vertically adjustable to produce a rocking action in a forward or rearward direction which made it easier to steer and maneuver the skate. Vertical adjustment of the intermediate wheel was achieved by a clamping bolt and a system of interlocking teeth and allowed a range of vertical adjustment.

In 1966, G. K. Ware in U.S. Pat. No. 3,287,023 disclosed an in-line skate with thin, rounded wheels which endeavored to simulate the performance of ice skates. The Ware skate utilized a fairly heavy metal frame having front and rear frame members with longitudinally extending and overlapping sections. Three sections had a multiplicity of horizontally arranged axle apertures which permitted positioning of wheel axles in a variety of different locations and provided continuous adjustability of the frame to accommodate a wide variety of boot sizes. The Ware frame also included the positioning of apertures at several elevations at the front and rear of the skate so that the forward and rear wheels could be a higher level than the two inter-mediate wheels. The Ware frame and variations of it are still in use on currently available in-line roller skates and has been the best all around frame available for such skates.

The Ware skate utilized a wheel formed of tough, firm but slightly soft and resilient rubber and having a central hub into which individual ball bearings were received and in which they were retained by a pair of cone elements which extended laterally from the wheel, so as to prevent contact between wheel and frame during cornering of the skate. A toe brake was utilized at the front end of the skate for stopping the skate.

U.S. Pat. No. 4,492,385 to Scott B. Olson disclosed a hybrid skate combining the desirable features of both ice and roller skates and featured a mounting system which could carry either the traditional ice skating blade or a series of in-line wheels.

Other tandem roller skates with various wheel structures and configurations are shown in U.S. Pat. No. 3,880,441 to Silver; U.S. Pat. No. 3,900,203 to Kukulowicz; U.S. Pat. No. 3,963,252 to Carlson; and U.S. Pat. No. 4,618,158 to Liberkowski. A number of distinct wheel structures have been developed for use with tandem skates, conventional roller skates and other roller devices, some of which are shown in U.S. Pat. Nos. 189,783, 2,670,242, 4,054,335 and 4,114,952.

Length has been the principal limitation on the number of wheels that can be utilized on a linear skate, for the use of too many conventionally mounted wheels means that at least one of such wheels must protrude an undesirable distance in front of the toe portion and behind the heel portion of the skater's boot.

It was in an effort to provide a design permitting an increased number of wheels on a linear skate as well as better traction and maneuverability that the present invention was evolved.

SUMMARY OF THE INVENTION

A roller skate in accordance with this invention utilizes a plurality of angularly mounted wheels disposed generally in an in-line relationship along the longitudinal axis of a mounting plate attached to the sole of a boot or shoe, with the treads of the wheels disposed in alignment. In accordance with one embodiment, the wheels of this skate are mounted in a relationship in which the wheels are disposed in an alternating angular array, with adjacent wheels disposed on opposite sides of a plane vertical to the mounting plate. It is preferable to call this V-line construction.

Another embodiment of this invention utilizes wheels mounted in a relationship in which the wheels are disposed in a consistently angled array, with adjacent wheels disposed on the same side of a plane vertical to the mounting plate of the skate.

Preferably each embodiment utilizes a mounting plate having first and second surfaces, with the first surface adapted to be removably fastened to the sole of a boot or shoe. A plurality of wheel mounting brackets are affixed in a spaced relationship along the longitudinal axis of the second surface of the mounting plate, with each of such brackets configured to support an axle upon which a wheel of the skate is rotatably mounted.

A mounting plate in accordance with this invention is equipped with uniformly placed mounting holes, and is removably attached to the skater's boot or shoe by the use of mounting bolts extending through the sole of the boot or shoe and thence through such holes. Appropriate fastening means are utilized on the end of each of such mounting bolts. Therefore, when it is desired to bring about a reversal of wheel angle, such can be effected by loosening the fastening means, turning the mounting plate end for end, and then reinstalling the mounting plate on the boot or shoe.

With further regard to placement of the wheel mounting brackets on the mounting plate in an alternating, non-vertical relationship thereto, a first of such brackets is secured to said mounting plate with a significant portion thereof disposed at a selected angle to the vertical. Adjacent this first bracket a second bracket is secured to the mounting plate at the same angle, but importantly, this latter angle is on the opposite side of the vertical in accordance with this preferred embodiment. Thereafter a third bracket is secured adjacent the second bracket, parallel to the first bracket, with this third bracket therefore being disposed at the same angle to the vertical as the first bracket. In accordance with this embodiment, these brackets thus serve to support the wheels of the skate in an alternating angular array, with the treads of the wheels disposed in alignment. These skates may utilize three, four or more wheel mounting brackets secured to the mounting plate, each supporting a respective wheel.

As previously mentioned, another embodiment of this invention involves the wheels all being angled in a like manner, or in other words, all of the wheels are disposed on the same side of the vertical. Skates utilizing identically angled wheels are advantageously utilized on skating rinks constructed on a comparatively short radius.

It is important to note that the alternate angular mounting of the wheel array enables the brackets to be mounted closer together along the longitudinal axis of the mounting plate than would otherwise have been possible without interference between the wheels, with the increased number of wheels and the angularity of alternate wheels enabling the user of the skate to obtain a better ride with more wheels under the foot, with little or no protrusion at the heel or toe of the skate. Skates utilizing alternately angled wheels are more important for outside use, such as for road and track.

This invention may also possess many ancillary features, such as the ready removability of the mounting plate from the shoe or boot, so that the mounting plate can be turned end-for-end and then reinstalled on the boot, thus to effect a reversal of wheel angularity. This is of consequence in skates having both odd and even numbers of wheels. As previously mentioned, two, three, five or more wheel mounting brackets may be mounted in an alternating angular relationship along the longitudinal centerline of the mounting plate.

When the wheels are all mounted on one side of the vertical, it may be appropriate to turn the mounting plate end for end, so that the skate can be readily converted from bi-directional use, to single directional use on a closed track.

It is therefore a primary object of this invention to provide a wheeled skate in the nature of an in-line skate, but with the wheels mounted angularly, for reasons of increased traction, maneuverability and speed.

It is another object of this invention to provide a wheeled skate in the nature of an in-line skate, but with the wheels mounted angularly upon a mounting plate that can be turned end for end and then quickly remounted so as to effect a change from a speed skate to a recreational and hockey skate.

It is yet another object of this invention to provide a wheeled skate whose wheels are mounted in a pattern of alternating angularity, with this arrangement enabling certain wheels of the skate to be in an almost vertical relationship during a turn as well as during a power stride or "push", thus to give the skater increased traction, power and speed.

It is still another object to provide a wheeled skate utilizing certain wheels mounted at a first angle to their mounting base, and with alternate wheels mounted at a second, essentially opposite angle with respect to the mounting base, with the alternate angular mounting of the wheels permitting a degree of overlap that in turn makes it possible to utilize more wheels on the skate than would be possible without the alternate angular mounting.

It is yet still another object of this invention to secure angled wheels of a linear skate on a mounting plate of a type that may be initially secured in a selected direction on the boot, and then later removed, turned end for end, and thereafter reinstalled on the boot, thus accomplishing a change in the angularity of the predominate number of inclined wheels.

It is still another object of this invention to provide a novel, cantilevered lever lock axle for supporting each wheel of the skate, this construction making it possible for a wheel to be quickly removed and immediately replaced without the need for the use of any kind of tool.

These and other objects, features and advantages of this invention will be apparent from a study of the appended drawings and text.

BRIEF DESCRIPTION OF DRAWINGS

FIG. 1 is a perspective view of a preferred embodiment of this in-line roller skate invention, revealing the mounting of the wheels of the skate on three mounting brackets disposed in an alternating angular manner, with the treads of the wheels disposed in alignment;

FIG. 2 is a view of the skate from a somewhat different perspective, with the wheels removed to reveal that the three wheel mounting brackets are disposed in a straight line along the underside of the mounting bracket;

FIG. 3 is a side elevational view of the preferred embodiment illustrated in the first two figures;

FIG. 4 is a rear view of the same skate, with this figure revealing that the wheel mounting bracket in the foreground is secured in an angular relationship to the mounting plate of the skate, thus causing the respective wheel to be supported at a desired angle to the vertical, whereas the wheel in the background is supported at an opposite angle to the vertical;

FIG. 5 is a view to a somewhat larger scale of a typical planar type wheel of the kind preferably used on these novel skates, with this view also representing a typical angle to the vertical at which the principal plane of the wheel is disposed;

FIGS. 6*a* and 6*b* are related figures representing rear views of left and right skates equipped with wheels of alternating angularity;

FIG. 7 is a view from below of a typical wheel arrangement for a three wheeled skate utilizing wheels of alternating angularity;

FIG. 7*a* is a rear view of a skate, revealing the utilization of mounting bolts protruding from the underside of a boot, which bolts are intended to enter like spaced holes in the mounting plate of one of these skates;

FIG. 8*a* is a view of a left boot, upon which the mounting plate of the left skate is disposed in a first position on the underside of the boot;

FIG. 8*b* is a view of the same left boot, upon which the mounting plate of the same left skate is disposed in a second position on the underside of the boot, with the turning of the mounting plate end-for-end serving to reverse the angularity of the wheels;

FIG. 9 depicts side-by-side rear views of a pair of skates involving alternately angled wheels utilized in identical configurations, that is, with the predominant number of wheels on the right hand side of both the left and right skates, which is an ideal arrangement for speed use on a rink constructed to a comparatively small radius;

FIG. 10 represents an embodiment of this invention in which all of the wheels of this in-line type skate are angled in an identical manner on the same side of a vertical plane, with no alternating wheel angularity being utilized;

FIG. 11*a* is a view relatable to the embodiment of FIG. 10 and reveals for a left boot, the preferred angularity of the wheels when the skate is to be used for speed on a track or rink of comparatively short radius;

FIG. 11*b* is a view likewise relatable to the embodiment of FIG. 10 and revealing for the same left boot, the preferred angularity of the wheels when the skate is to be used outdoors, such as for recreational skating, art skating, or hockey.

FIG. 12 is a rear view of the left boot, revealing the preferred angularity of the wheels when the skate is to be used on a short radius track;

FIG. 13 is a view to a somewhat larger scale of what is deemed to be a typical weldment, this being a wheel mounting bracket that has been welded at a preferred angle to the mounting plate of the skate;

FIG. 14 is a view of a cast plate of the type that contains multiple wheels, ranging in number from two to five or more wheels, which wheels may have either identical or alternating angularity;

FIG. 15 is a view of still another wheel mounting arrangement;

FIG. 16 is a view of an individual wheel casting of the type that may be riveted to a mounting plate in a relationship involving the wheels residing in either alternating angularity or in non-alternating angularity;

FIG. 17 is a view exemplifying the manner in which the wheels of this linear skate may reside in an overlapping relationship made possible by the utilization of alternating wheel angularity, with this arrangement making possible the incorporation of an increased number of wheels on a skate of a particular size;

DETAILED DESCRIPTION

Figure 18:
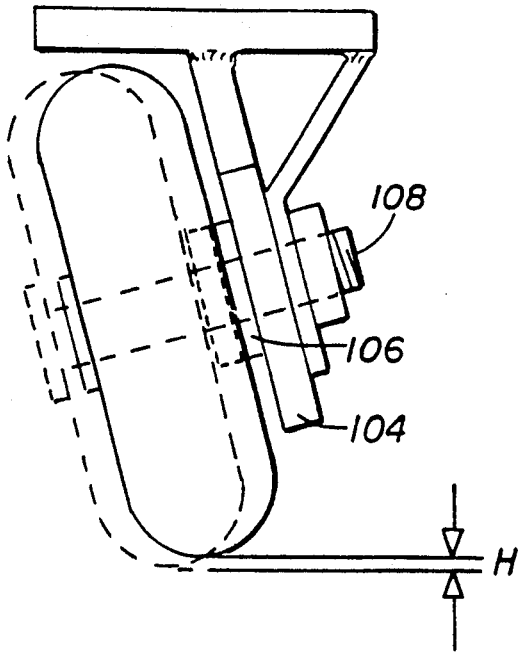
FIG. 18 is a view of an angled wheel mounting bracket, in this instance revealing that the wheel optionally may be offset downwardly to a slight extent, with respect to the other wheels of the skate, such as by the use of a flat washer.

With initial reference to FIG. 1, there shown is a preferred embodiment of a roller skate 10 utilizing angularly mounted wheels 12, 14 and 16 placed generally in an in-line relationship, with the tread portions of the wheels disposed in alignment. This alignment of the tread portions is exemplified by the relationship of the lower edges of these wheels to the line 18. The skate 10 utilizes a mounting plate 20 providing a surface adapted to be fastened to the sole of a shoe or boot 21.

A plurality of mounting brackets 22, 24 and 26 are affixed in a spaced relationship along the longitudinal axis 28 of the surface of the mounting plate 20 opposite the boot or shoe, as best seen in FIG. 2. Each of the brackets is provided with a tapped mounting hole configured to threadedly receive an axle upon which a respective wheel of the skate is rotatably mounted. In FIG. 2 it will be seen that these are tapped holes 32, 34 and 36 respectively. It is important to note that the preferred embodiment of this invention involves the brackets being secured upon the mounting plate in an alternating, non-vertical relationship thereto, as will be noted from these first two figures.

A first of the brackets, bracket 22, is secured adjacent the toe portion of the mounting plate 20 at a selected angle to the vertical. Adjacent bracket 22 the second mounting bracket, bracket 24, is secured to the mounting plate at the same angle, but on the opposite side of the vertical. In other words, bracket 24 is disposed in what may be regarded as an opposite angular relationship to the mounting bracket 22.

With continuing reference to FIGS. 1 and 2, it will be noted that the third mounting bracket, bracket 26, is secured adjacent the second bracket in a parallel relationship to the first bracket, with the third bracket 26 therefore being disposed at the same angle to the vertical as the first bracket. The three brackets 22, 24 and 26 thus serve to respectively support the wheels 12, 14 and 16 of this skate embodiment in an alternating angular array, with the treads of the wheels disposed in alignment along the line 18, as mentioned hereinbefore.

This invention is not limited to any particular constructional materials, but in the embodiments revealed in the first several figures of the drawings, the mounting plate 20 is constructed of 6061 T6 aluminum 3/16 inch thick, with the wheel mounting brackets constructed of like material, which brackets are secured to the mounting plate such as by tungsten inert gas welding, this being commonly known as "TIG" welding. It is to be understood, however, that the mounting plates and the wheel mounting brackets may be made of other light metals, or of certain structural plastics.

From FIG. 2 it will be noted that a plurality of mounting holes 38 has been provided in a standardized spaced array, these holes being provided for a purpose shortly to be described.

It is important to note that the alternating angular mounting relationship of the wheel array advantageously enables the brackets to be mounted closer together along the longitudinal axis 28 of the mounting plate 20 than would otherwise have been possible without the wheels being in an interfering relationship to each other. This will be discussed hereinafter in connection with FIG. 17. The alternate angular relationship in accordance with this invention also enables the user of the skate to achieve improved traction during turns, and during the skater's power stroke.

With reference to FIG. 3 it will be seen that a side elevation of this novel skate 10 has been provided, with it to be noted that when three wheels are utilized on an adult size skate, there is little crowding. It is to be noted that when constructing a child's skate, for example, it is possible in accordance with this invention to increase the number of wheels utilized on the skate if the wheels are disposed in an alternately inclined relationship.

It will be noted in FIG. 4 that a rear view of the boot 21 has been shown, with the mounting plate 20 mounted on the underside of the boot, and from this figure it may be clearly seen that a significant portion of the rearmost wheel mounting bracket 26 is disposed at a distinct angle to the vertical. Because of this, the axle 46 associated with bracket 26 is disposed at an angle to the horizontal, such that the wheel 16 mounted on the axle 46 is disposed at an angle to the vertical. Also visible in FIG. 4 is the wheel 14, the middle wheel of this skate, and from this figure it will be realized that the wheels 14 and 16 are each disposed in an angular relationship to the vertical, but on opposite sides of the vertical. It is preferred to call this V-line construction.

In FIG. 5 are revealed the wheels 16 and 14 to an enlarged scale, and it is to be realized that the angle $\theta$ represents the angle that the center plane of wheel 16 bears to the plane that is vertical to the mounting plate. It has been established that an angle of 16° to the vertical is ideal, but obviously the present invention is not to be limited to this, for it has been found that the angle $\theta$ can range between 11° and 21° from the perpendicular.

Inasmuch as the wheels 16 and 14 are ordinarily to be angled identically with respect to the vertical plane, there will be a 32° angle between the planes of the respective wheels when each wheel bears a 16° relationship to the vertical plane.

With reference now to FIGS. 6*a* and 6*b*, left and right boots have there been shown, on the underside of each of which a mounting plate is secured, with an angled wheel mounting bracket attached to the mounting plate. In this particular instance, the wheels supported by these wheel mounting brackets are disposed vertically, which is the typical position of these wheels when the skater is executing a turn. It has been established that when the wheels are in an essentially vertical relationship to the surface on which the person is skating, the wheels have much better traction and roll, which in turn makes it possible for the skater to attain more speed, and have more maneuverability.

FIG. 7 reveals the underside of the skate depicted in FIG. 3, with this figure making clear that the three wheels are disposed in an alternating angular relationship, and also revealing that the treads or contact points of these wheels are disposed along a common line. This common line is parallel to the centerline 28 of the mounting plate, upon which the respective wheel mounting brackets are secured.

It is also revealed in FIG. 7 that the mounting plate 20 has four mounting holes 38. In accordance with this invention, four studs or mounting screws can be mounted in the sole of the boot 21 in a pattern coinciding with the placement of the mounting holes 38, such that upon the holes 38 in the mounting plate 20 being placed over the studs or screws, the mounting plate can be secured to the boot by suitable fastening means, such as four nuts utilized with lock washers, which may for example be star washers.

With reference now to FIG. 7*a*, it will be seen that a typical mounting detail has been shown, in which holes were drilled or otherwise formed in each boot, into which holes mounting screws or bolts 48 have been tightly inserted, such that they are not dislodged except with deliberate effort. Although this invention is not to be limited to any particular size screw, usually a 10–32 screw is preferred. After the four screws have been inserted through the corresponding holes in the mounting plate, appropriate fastening means are utilized to secure the mounting plate to the boot or shoe. Such fastening means could for example involve nuts used with star washers, or other type lock washers.

Turning now to FIGS. 8*a* and 8*b*, it will be seen in FIG. 8*a* that the underside of a typical left boot has been shown, secured to which is a mounting plate 20 having three wheels and equipped with four mounting holes 38. Because in accordance with this invention, four mounting screws have been mounted in the sole of the boot in a pattern coinciding with the placement of the mounting holes 38, the mounting plate 20 can be readily secured to the boot 21 by suitable fastening means, such as four nuts.

It is to be noted that the configuration of the angled wheels depicted in FIG. 8*a* is appropriate for use in a rink or track constructed on a comparatively short radius.

It will be noted from FIG. 8*b* that the same left boot that was depicted in FIG. 8*a* has here been shown, but in this instance, the mounting plate 20 has been turned end-for-end. This reorientation of the mounting plate is connoted by the double headed arrow, and because a standardized pattern of mounting holes has been utilized, and the positioning of the wheels on the mounting plate has been standardized, the mounting plate will function equally well in the reversed position on the boot.

It will be obvious from comparing FIG. 8*b* with FIG. 8*a* that the angularity of the wheels has been changed by this repositioning of the mounting plate, which causes the skate to be converted from a configuration ideal for use on a short radius track, to a configuration appropriate for use outdoors, such as for art skating, recreational, hockey or the like.

It is important to note that although the angularity of the wheels has been effectively changed by the reversal of the mounting plate position, the symmetrical and consistent positioning of the wheels on the mounting plate 20 causes the longitudinal positions of the wheels on the boot to remain unchanged.

In FIG. 9 a pair of skates is revealed in a side-by-side relationship, involving alternately angled wheels utilized in identical configurations. By this is meant that the predominant number of wheels is on the right hand side of both the left skate as well as the right skate. This is an ideal arrangement for use on a skating rink constructed to a comparatively small radius, for in such instance the skater is essentially in a turning attitude the entire time, and this placement of wheels provides superior traction and speed at such times. The wheel configuration shown in FIG. 9 would not, however, be suitable for use outside, where it is unlikely that the skater would be in a constant left turn relationship.

In FIG. 10 is shown an embodiment of this invention in which all three wheels of the skate possess identical angularity, being disposed on the same side of the vertical. Wheels 52, 54 and 56 are supported by wheel mounting brackets 62, 64 and 66, respectively, with the significant portion of each of these brackets being disposed at an identical angle to a plane perpendicular to the mounting plate 60. The brackets 62, 64 and 66 are secured at spaced locations along the longitudinal axis 68 of the mounting plate 60; see FIGS. 11*a* and 11*b*.

The type of wheel configuration shown in FIG. 10 is ideal for use on a short radius track, for inasmuch as the skater is, in a manner of speaking, in a constant turn relationship, the placement of all of the wheels at the same identical angle to the vertical means that the skater will be afforded more traction and speed as well as more maneuverability than would have been the case if less than all the wheels were at the same angle and on the same side of the vertical. Two wheels disposed at a constant angularity can be used on a skate, but in many instances the optimum number of wheels is three.

As made clear from related FIGS. 11*a* and 11*b*, the earlier mentioned concept involving the use of a readily reversible mounting plate is applicable when skates equipped with wheels of identical, non-alternating angularity are being utilized. In FIG. 11*a*, a left boot equipped with wheels of the same angularity is shown, disposed in a configuration ideal for use on a short radius track. By loosening the nuts or other fastening means serving to hold the mounting plate 60 to the boot shown in FIG. 11*a*, the skater can readily reverse the position of the mounting plate, and secure it in the position depicted in FIG. 11*b*. The wheel configuration in FIG. 11*b* would be suitable for art skating, recreation, hockey or the like.

It is to be noted that inasmuch as the skaters move around a rink in a counter-clockwise direction, they are in effect making almost continuous left turns. For this reason, it would not be appropriate to remove the mounting plate from the right skate and turn it end for end, but it would be highly appropriate for rink use for the mounting plate of the left skate to be removed, turned end for end, and then re-secured to the boot or shoe. The mounting plate for the right skate could be secured to the boot or shoe in the same manner as the left skate, or it could be permanently riveted to the sole of the boot or shoe.

In FIG. 12 is shown a rear view of the skate illustrated in FIG. 11*a*.

In FIG. 13 is revealed a wheel mounting bracket 78 secured by TIG welding or the like to the mounting plate 80, with the angularity of the principal portion of the mounting bracket causing the axle used therewith to dispose the wheel in an angular relationship to the vertical. As is obvious, the wheel axle is supported only at one end, in what may be regarded as a cantilevered arrangement.

In FIG. 14 is revealed a somewhat different wheel mounting arrangement, which can involve a cast or forged mounting plate 84, which can directly serve as the mounting means for two, three, four or five wheels, possibly more, depending on the size of the wheels. In this embodiment of a wheel mounting arrangement, the wheels can have either alternate or non-alternate angularity with regard to the mounting plate. Although aluminum could be utilized in the construction of the plate, it is also possible to utilize magnesium or titanium in creating the plate, and it is also possible to utilize certain types of industrial plastic as well.

With reference to FIG. 15 it will be seen that an embodiment of a wheel mounting bracket 88 has been shown, in which both ends of the axle are supported. In this instance a device of more or less U-shaped configuration has been utilized, with the upper part of the U being riveted or otherwise secured to the mounting plate 90. This embodiment is particularly suited for use in the construction of low cost skates and it is to be noted that this arrangement can be utilized for supporting either wheels of alternating angularity, or wheels disposed only on one side of a plane vertical to the mounting plate. In this type of mounting, a pair of screws 89 can be used for securing the wheel in the desired relationship to the bracket.

In FIG. 16 is shown a wheel mounting bracket 94 of the type utilizing a cantilevered support arrangement for a single wheel, with the upper part of the mounting bracket typically being riveted to the mounting plate. This construction involves a single cast bracket for supporting one wheel, which can be placed at either alternate angles or non-alternate angles on the respective base plate.

Provided in FIG. 17 is an idealized showing of the wheel relationship involved in a conventional five wheel linear skate, with the dimension B showing the necessary length to be taken into consideration in the design of the skate if the wheels are not to rub against each other. In this instance, the five wheels are shown in dashed lines.

Contrasting with this is the dimension W, representing the length involved if the wheels are alternately angled in accordance with the embodiment discussed in FIGS. 1 through 3 and 7, as well as shown in FIGS. 8*a* and 8*b*. The angled wheels are shown in full lines. As previously mentioned, the alternate angling of the wheels makes it possible to "pack" or "interleave" the wheels in a non-interfering relationship, such that the same number of wheels can be utilized in a smaller space. This advantageous result is one of the significant aspects of this invention.

In FIG. 18 is revealed a wheel mounting bracket 104 in which a washer 106 has been utilized on the angled wheel axle 108 at a location serving to cause the wheel to be spaced an increased distance away from the wheel mounting bracket. This causes the tread of the wheel to be a slightly increased distance away from the mounting plate, such distance in this instance being indicated by the letter H.

Figure 19:
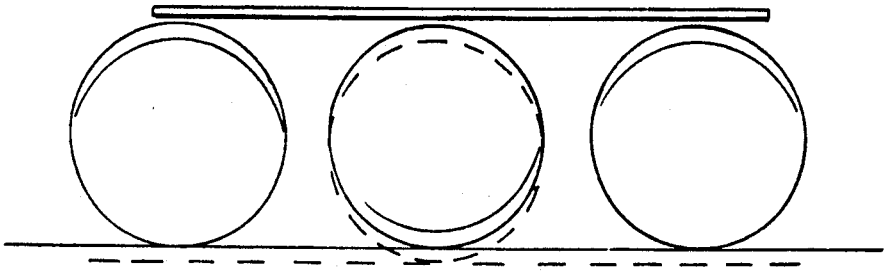
FIG. 19 is an idealized showing of the wheels of a three wheeled skate, this view revealing that the middle wheel may be offset somewhat downwardly with respect to the other two, thus to make it possible for the skater to execute turns more easily.

With reference to FIG. 19, this idealized figure is utilized to indicate that the middle wheel may be spaced slightly further away from the mounting plate than the other two, which serves the function of increasing the ability of the skater to execute comparatively sharp turns.

Figure 20A:
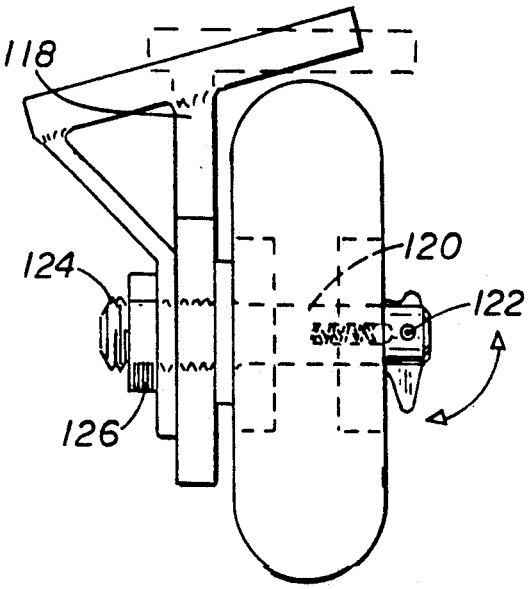
FIG. 20*a* is a view to a large scale of a typical angular mounting bracket in accordance with this invention, wherein for wheel support a lever lock axle is utilized, that simplifies the ready removal of a skate wheel of one type, so that a wheel of another type may be immediately substituted, such as during a race, to take weather and surface conditions into consideration.

In FIG. 20*a* an angled wheel mounting bracket 118 supporting a cantilevered axle 120 is revealed. This is not an ordinary axle, however, but rather is an axle utilizing a so-called lever lock 122.

The standard lever lock axle for use on quad type roller skates is designed to be utilized with a pair of wheels, and has a knurled middle portion. A prior art axle of this type is intended to be pressed into a suitable wheel mounting bracket, such that its middle portion is supported by the bracket, with each end being configured to receive a wheel of the skate.

The lever lock axle utilized is of a cantilever type, being threaded at one end so that it can be threaded into a wheel mounting bracket of the type herein employed, whereas the other end of the axle is arranged to receive a wheel of the appropriate size and hardness. The use of the highly advantageous lever lock principle makes it but a simple matter to remove a wheel of one type from the skate, and to promptly substitute another.

For example, it is well known that when hard wheels are utilized, the skater can attain greater speed, but should the surface be wet or bumpy, falls are much more likely. Therefore, it is customary to replace hard wheels with somewhat softer wheels under conditions of an adverse road surface.

As should be apparent, the threaded end 124 of the lever lock axle 120 threadedly engages the threaded hole in the mounting bracket 118, and to prevent loosening of the axle, a locknut 126 is typically placed on the threads of the axle, as shown in FIG. 20*a*, which is tightened very tightly.

It is to be noted that a lever lock axle is preferably utilized for outdoor use, when the wheels of the skate are of alternating angularity.

Figure 20B:
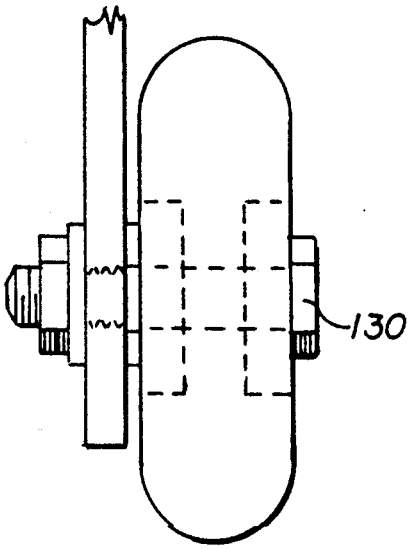
FIG. 20*b* is a view closely resembling FIG. 20*a*, wherein the wheel is supported by a conventional axle requiring the use of a wrench for wheel substitution.

In FIG. 20*b* a skate wheel supported by what may be regarded as a conventional axle 130 is shown, the disadvantage being that a wrench is needed in order for the skater to be able to substitute one type of wheel for another.

Figure 21:
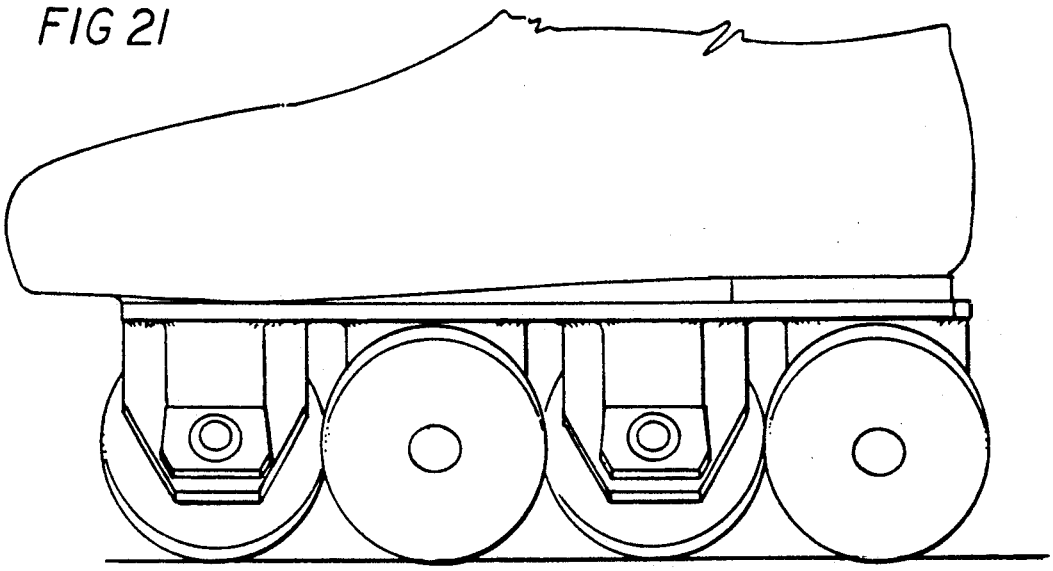
FIG. 21 is a view of a skate to be worn on the right foot, showing how the alternating angularity of the wheels makes possible an overlapping wheel relationship such that an increased number of wheels can be utilized on the skate.

In FIG. 21 a right skate equipped with four wheels is illustrated, with two wheels disposed on one side of the vertical, and the other two wheels disposed on the other side of the vertical, with alternating angularity being utilized. This arrangement readily enables the "interleaving" of the wheels, so that more wheels can be utilized on the skate than would have otherwise been possible.

Figure 22:
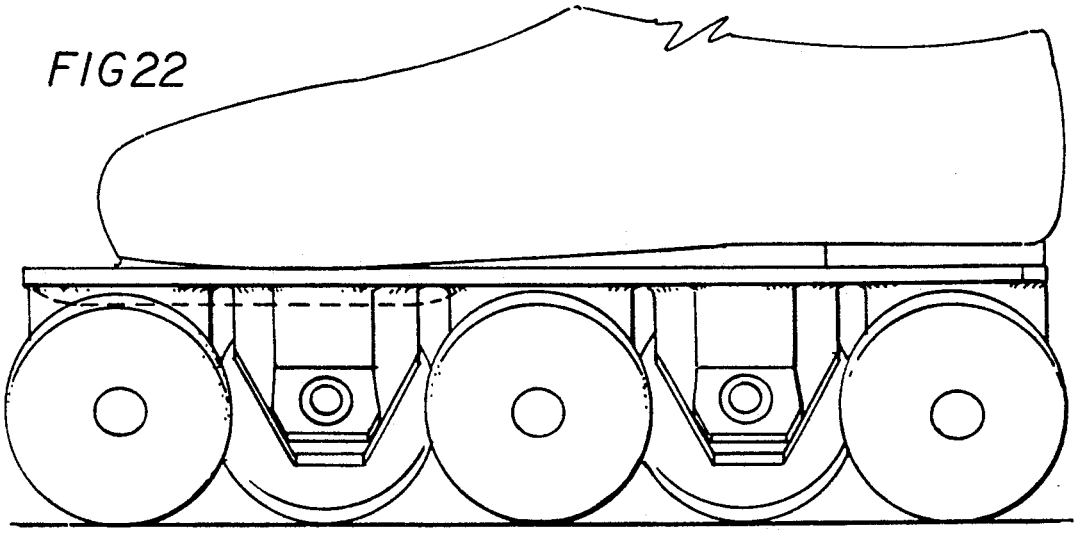
FIG. 22 is a view of a skate to be worn on the left foot, showing how the alternating angularity of the wheels makes it possible for the wheels to be disposed in an overlapping relationship, such that five wheels can be utilized on the skate.

In FIG. 22 a left skate equipped with five wheels is shown, and because of the alternating angularity that is utilized, it is obviously possible to "pack" the wheels more tightly than would have been possible if all of the wheels possessed the same angularity.

It is to be understood that when a skate is equipped with an odd number of wheels of alternating angularity, removal of the mounting plate from the boot or shoe, turning it end for end, and then re-securing it to the boot or shoe accomplishes a change of angularity of the predominant number of wheels on the skate.

It is to be noted in FIG. 22 that a plate reinforcement 96 is utilized for preventing undesired bending in the extended mounting plate.

Figure 23:
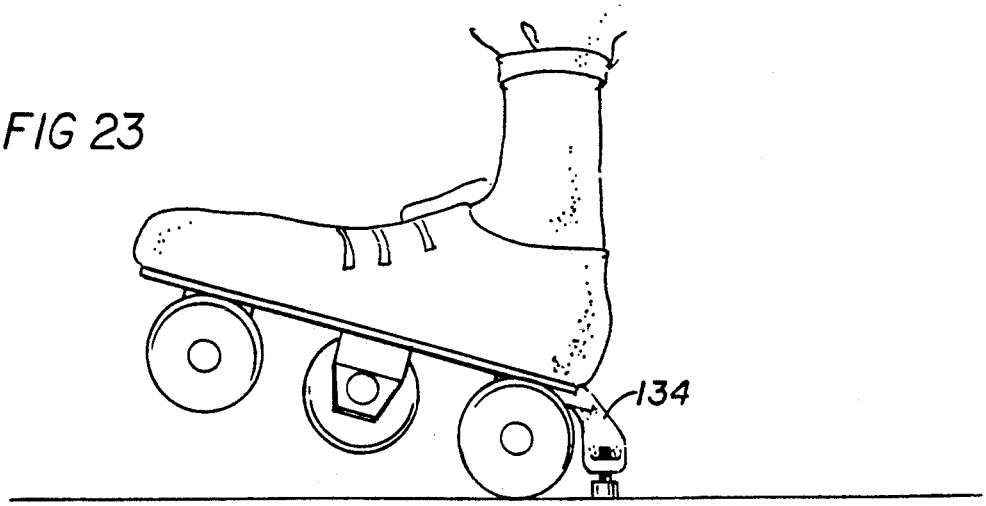
FIG. 23 is a view of one of the novel skates being utilized with a heel brake.

In FIG. 23 the use of a heel brake 134 in accordance with a skate of the present design is revealed.

Although different skate wheels can be utilized in accordance with this invention, it has been found that the most suitable wheel for indoor use is a full radius wheel of one inch thickness, having a diameter of 72 mm, and having a durometer hardness of 93. Such a wheel is made by Hyper Wheel Company of Huntington Beach, Calif.

For outdoor use, the wheel can be of the same diameter and thickness, but having a durometer hardness of 85, which is appropriate for dry weather. If the road is rough or wet, a durometer hardness of 78 is more appropriate.

This invention is not limited to skates -made by welding, for as an alternative the wheel mounting brackets could be fastened to the mounting plate by swaging and riveting.

It should now be clear that a key point of this invention is the fact that a predominant number of the wheels of this skate are very close to being vertical during turns, when maximum traction is desired. The wheel whose principal plane is nearly vertical also rolls better than does an inclined wheel.

It is to be realized that in prior art linear skates, the wheels are frequently disposed out of the positions most favorable to optimum wheel rotation. In other words, the bearings of a tilted skate wheel have somewhat increased friction, and the tread portion of the wheel has somewhat less traction. The generally planar, angularly placed wheels of the skates of this invention are favorably positioned a high percentage of the time that the skates are in use.

I claim:

1. A roller skate utilizing angularly mounted wheels disposed generally in an in-line relationship, said skate comprising a mounting plate having a pair of oppositely disposed surfaces, with one of said surfaces being adapted to be fastened to the sole of a boot or shoe, means for mounting a plurality of angularly disposed wheels on said mounting plate, said wheels being affixed in a consistent, evenly-spaced relationship to the other surface of said mounting plate, along the longitudinal axis thereof, with the treads of at least three of said wheels disposed in alignment, each of said wheels of said skate being disposed at an angle between 11° and 21° to the vertical, with at least two of said angularly disposed wheels being inclined in the same direction with regard to a vertical plane passed along the longitudinal axis of said mounting plate, and an intermediate, angularly mounted wheel located an equal distance between said at least two angularly disposed wheels and inclined in an opposite direction with respect to said at least two angularly disposed wheels, the non-perpendicular relationship of said wheels to said other surface of the mounting plate enabling a user of the skate to achieve improved traction during a turn.

2. The roller skate utilizing angularly mounted wheels as recited in claim 1 in which said wheels are supported on individual mounting brackets affixed to said mounting plate.

3. The roller skate utilizing angularly mounted wheels as recited in claim 1 in which said wheels are supported from a common mounting bracket affixed to said mounting plate.

4. The roller skate as recited in claim 1 in which said mounting plate is equipped with uniformly placed mounting holes, and is removably attached to the skater's boot or shoe by the use of fastening means interacting with mounting screws that extend through the sole of the boot or shoe and through such holes, the wheels of said skate being disposed in a non-symmetrical relationship to the vertical plane passed along the longitudinal axis of said mounting plate, with a predominant number of the wheels of the skate having the same angularity, a reversal of wheel angle being able to be readily effected by loosening the fastening means, turning the mounting plate end for end, and then by the use of the fastening means, reinstalling the mounting plate on the boot or shoe, such reversal of the direction of said mounting plate serving to change the angularity of the predominant number of wheels on the skate.

5. The roller skate as recited in claim 4 in which said fastening means compromise nuts.

6. The roller skate as recited in claim 1 in which said means for mounting each wheel is a lever lock axle disposed in a cantilever manner upon said mounting plate, such that the wheel carried by the axle can be quickly replaced.

7. A roller skate utilizing at least three closely spaced, angularly mounted wheels disposed generally in an in-line relationship, said skate comprising a mounting plate having a pair of opposite surfaces, with one of said surfaces adapted to be fastened to the sole of a boot or shoe, a plurality of wheel mounting brackets affixed in a consistently spaced, close relationship along the longitudinal axis of the other surface of said mounting plate, with each of said brackets configured to support an axle upon which a wheel of the skate is rotatably mounted, said brackets being secured upon said mounting plate in an alternating, non-vertical relationship thereto, a first of said brackets being secured to said mounting plate with a significant portion thereof disposed at a selected angle to the vertical, closely adjacent which a second bracket is secured to said mounting plate at the same angle, and on the opposite side of the vertical, a third bracket secured closely adjacent said second bracket, parallel to said first bracket, with said third bracket therefore being disposed at the same angle to the vertical as said first bracket, with said brackets thus serving to support the wheels of the skate in an evenly-spaced, alternating angular array, with treads of the wheels disposed in alignment, the alternate angular mounting of the wheel array enabling said brackets to be mounted close together along the longitudinal axis of said other surface of said mounting plate with the wheels in an overlapping relationship in which undesirable contact from one wheel to another is avoided, the angularity of the wheels enabling the user of the skate to achieve improved traction during a turn and a power stroke.

8. The roller skate as recited in claim 7 in which a minimum of four wheel mounting brackets are mounted in an alternating angular relationship along the longitudinal axis of said mounting plate.

9. The roller skate as recited in claim 7 in which said mounting plate is equipped with uniformly placed mounting holes, and is removably attached to the skater's boot or shoe by the use of mounting screws extending through the sole of the boot or shoe and through such holes, with fastening means utilized in conjunction with said screws to hold said mounting plate in place on the boot or shoe, the wheels of said skate being disposed in a non-symmetrical relationship to a vertical plane passed along the longitudinal axis of said mounting plate, with a predominant number of the wheels of the skate having the same angularity, a reversal of wheel angle being effected by loosening the fastening means, turning the mounting plate end for end, and then reinstalling the mounting plate on the boot or shoe, the reversal of direction of said mounting plate serving to change the angularity of the predominant number of wheels on the skate.

10. A roller skate utilizing at least three angularly mounted wheels disposed generally in an in-line relationship, said skate comprising a mounting plate having a pair of oppositely disposed surfaces, with one of said surfaces being adapted to be fastened to the sole of a boot or shoe, wheel mounting bracket means affixed along the longitudinal axis of said other surface of said mounting plate, with said bracket means configured to angularly support at least one axle upon which a wheel of the skate is rotatably mounted, with the treads of the wheels disposed in alignment, the wheels of said skate being disposed in an evenly-spaced, non-symmetrical relationship to a vertical plane passed along the longitudinal axis of said mounting plate, with at least two of said wheels being inclined at the same angle, and in the same direction with regard to the plane vertical to said mounting plate, each of said wheels of said skate being disposed at an angle between 11° and 21° to the vertical, with an angularly disposed wheel mounted in an intermediate position between such wheels inclined at the same angle and with the wheel in the intermediate position disposed in a direction opposite thereto, the angular disposition of the wheels enabling the user of the skate to achieve improved traction during a turn and a power stroke.

11. The roller skate utilizing at least three angularly mounted wheels disposed generally in an in-line relationship as recited in claim 10 in which a minimum of three wheel mounting brackets are mounted in an angular relationship along a longitudinal centerline of said mounting plate.

12. The roller skate utilizing at least three angularly mounted wheels disposed generally in an in-line relationship as recited in claim 10 in which a minimum of four wheel mounting brackets are mounted in an angular relationship along a longitudinal centerline of said mounting plate.

13. The roller skate utilizing at least three angularly mounted wheels disposed generally in an in-line relationship as recited in claim 10 in which a minimum of five wheel mounting brackets are mounted in an angular relationship along a longitudinal centerline of said mounting plate.

14. The roller skate utilizing at least three angularly mounted wheels disposed generally in an in-line relationship as recited in claim 10 in which said mounting plate is equipped with uniformly placed mounting holes, and is removably attached to the skater's boot or shoe by the use of mounting screws extending through the sole of the boot or shoe and through such holes, and fastening means interacting with said screws for holding the mounting plate in position on the sole of the boot or shoe, with a predominant number of the wheels of the skate having the same angularity, a reversal of wheel angle being readily achieved by loosening the fastening means, turning the mounting plate end for end, and then reinstalling the mounting plate on the boot or shoe, the reversal of direction of said mounting plate serving to accomplish a change of angularity of the predominant number of the wheels because of the non-symmetrical relationship of the wheels to the plane vertical to the longitudinal axis of said mounting plate.

15. The roller skate utilizing at least three angularly mounted wheels disposed generally in an in-line relationship as recited in claim 14 in which said fastening means are nuts.

16. The roller skate utilizing at least three angularly mounted wheels disposed generally in an in-line relationship as recited in claim 10 in which the axle supported by said bracket means is a lever lock axle mounted in a cantilever manner from said bracket means, such that the wheel carried by the axle can be quickly replaced.

* * * * *